United States Patent [19]

Szurman et al.

[11] 4,196,052

[45] Apr. 1, 1980

[54] HEATING WALL CONSTRUCTION, PARTICULARLY FOR USE IN COKING OVENS

[75] Inventors: Erich Szurman, Velbert; Rainer Worberg; Werner Eisenhut, both of Essen, all of Fed. Rep. of Germany

[73] Assignee: Bergwerksverband GmbH, Essen, Fed. Rep. of Germany

[21] Appl. No.: 890,191

[22] Filed: Mar. 27, 1978

[30] Foreign Application Priority Data

Mar. 26, 1977 [DE] Fed. Rep. of Germany ..... 2713461

[51] Int. Cl.[2] ..... C10B 5/02; C10B 29/02

[52] U.S. Cl. ..... 202/138; 165/106; 202/139; 202/141; 202/223; 202/267R; 432/223

[58] Field of Search ..... 202/138, 139, 145, 222, 202/223, 239, 267, 114, 126, 141, 142; 432/223, 247, 249; 165/106

[56] References Cited

U.S. PATENT DOCUMENTS

| | | | |
|---|---|---|---|
| 1,816,794 | 7/1931 | Pieters | 202/223 X |
| 1,989,459 | 1/1935 | Parker | 202/223 X |
| 2,839,453 | 6/1958 | Becker | 202/139 X |
| 3,359,184 | 12/1967 | Thiersch et al. | 202/138 X |
| 3,809,620 | 5/1974 | Wackerbarth et al. | 202/139 |

OTHER PUBLICATIONS

S. T. Hsu, Engineering Heat Transfer, pp. 381-394 (1963).

*Primary Examiner*—Joseph Scovronek
*Attorney, Agent, or Firm*—Michael J. Striker

[57] ABSTRACT

A heating wall of a coking oven, particularly a horizontal coking oven, separates the coking chamber of the coking oven from the heating flues through which a heating medium flows to heat a charge of coking coal which is contained in the coking chamber. The heating wall is provided with a plurality of individual compartments which are separated from each other and also from the coking chamber and from the heating flues, the compartments being situated between the coking chamber and the heating flues and increasing the rate of heat transmission through the heating wall. Depending on the desired heat-transmission properties of different portions of the heating wall, the compartments may be distributed either uniformly or nonuniformly, or may have the same or different dimensions. The heating wall is constituted by refractory blocks and the enclosed compartments are provided in these refractory blocks. One or more of these compartments may be enclosed within a single block or respective zones of adjacent ones of these blocks may together enclose the compartments. In addition to coking ovens, this type of heating wall can also be used in other applications, particularly where the heating wall is subjected to temperatures exceeding 1000° C. for extended periods of time.

7 Claims, 4 Drawing Figures

FIG. 1a
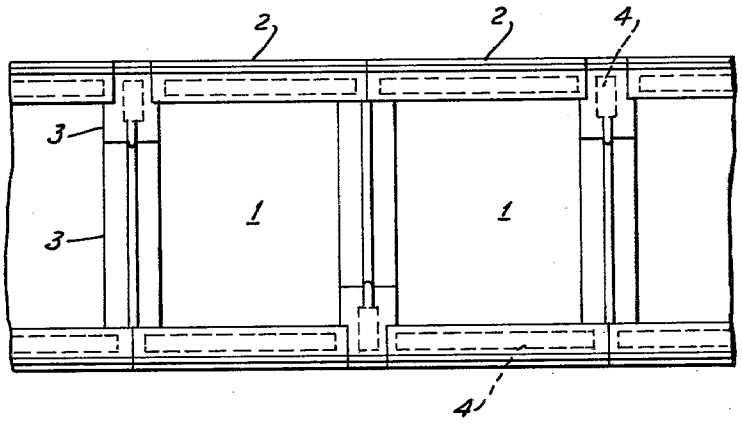
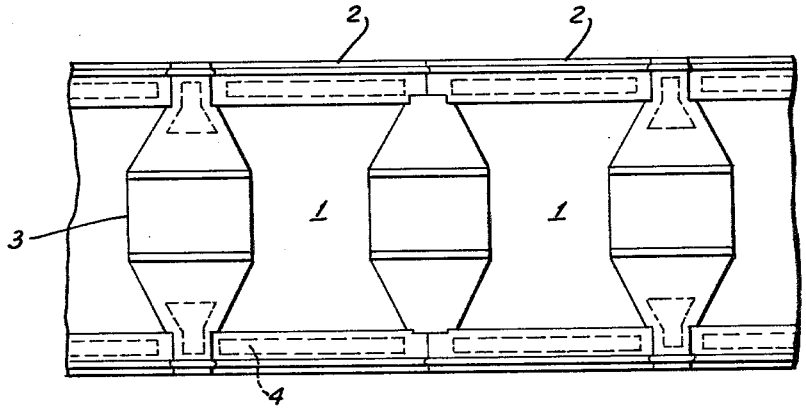
FIG. 1b

FIG. 2a
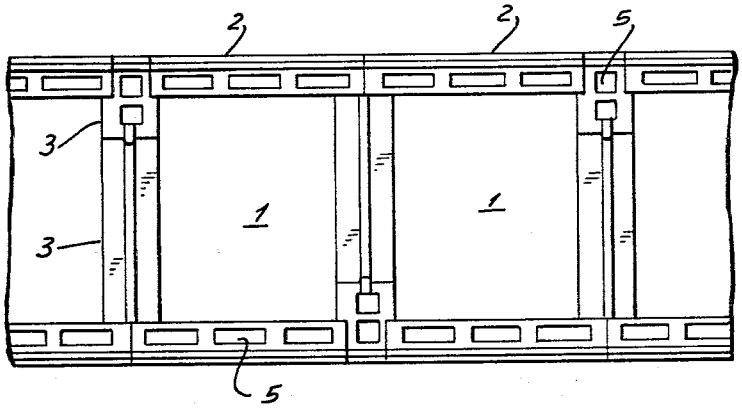
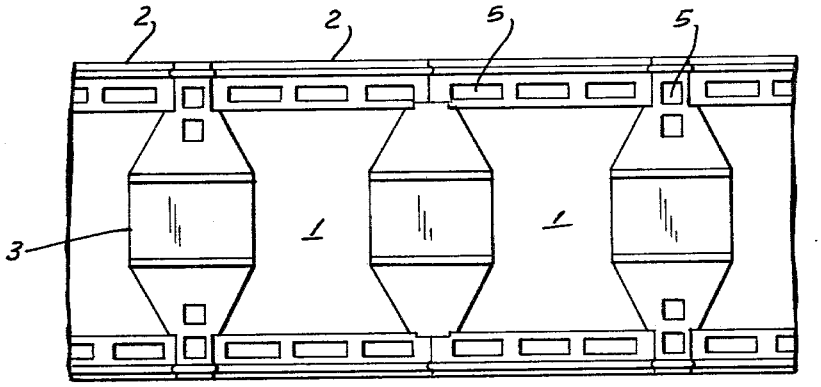
FIG. 2b

HEATING WALL CONSTRUCTION, PARTICULARLY FOR USE IN COKING OVENS

BACKGROUND OF THE INVENTION

The present invention relates to a heating wall in general, and more particularly to a heating wall for use in a coking oven, especially in a horizontal coking oven, for separating a coking chamber from heating flues.

Various constructions of coking ovens are nowadays in use and are so well known that they need no detailed discussion here. Suffice it to say that, usually, a charge of a coking coal to be coked is confined in a coking chamber which is partially bounded by heating walls, and the charge of the coking coal is heated to the desired coking temperature by passing a heated fluid through heating flues which are separated from the coking chamber by the respective heating walls. More often than not, the coking ovens are arranged in a battery and are constructed as composite regenerative ovens which can be selectively heated either by a rich gas of a high calorific value which need not be preheated prior to its combustion with the combustion-supporting air which has been previously subjected to a regenerative heat exchange with the combusted exhaust gases, or by a lean gas of a low calorific value which is also subjected to a regenerative pre-heating prior to its combustion with the combustion-supporting air. The heat which is obtained by the combustion of the gases with the combustion-supporting air in heating flues of the coking oven and which is needed for the coking operation is transmitted to the charge contained in the coking chamber, through the heating walls which separate the heating flues from the interior of the coking chamber. Such heating walls usually consist of blocks of refractory material which include separating blocks extending along and bounding the coking chamber, and transverse blocks which extend from the separating blocks away from the coking chamber and separate individual ones of the heating flues of the respective heating wall from one another.

It is also known that the transmission of the heat which is generated in the heating flues to the coal contained in the coking chamber improves with the decreasing thickness of the separating blocks. It is further known that the heat transmission can be further improved when the separating blocks are made, instead of the customary silica material, of a different high-quality refractory material which has a heat-transmitting capability exceeding that of the silica material.

There are also already known special configurations of both the separating blocks and the transverse blocks. So, for instance, as revealed in the German published patent application DT-AS 1,264,393 the refractory blocks may be provided with recesses which are so configurated that the respective refractory blocks obtain vertical and/or horizontal ribs which project into the respective associated heating flue. In this manner, it is achieved that the heat transmission is better in the region of the recesses than in the region of the ribs. However, experience has shown that this configuration of the refractory blocks does not noticeably improve the transmission of heat therethrough.

On the other hand, as disclosed, for instance, in the German published patent application DT-AS 1,421,285 the separating or transverse refractory blocks may be formed with tubular channels. These blocks are then so combined with one another in the heating wall that the individual channels of the refractory blocks communicate with one another and constitute through ducts in the heating wall. Then, gaseous media are conducted through these ducts which serve the purposes of heating or of heat exchange. However, even here, no appreciable improvement in the heat-transmissivity of the heating wall has been observed.

In industrial applications, there have been so far tested border blocks down to a lowest thickness of 70 millimeters, even though, as disclosed in the German published patent application DT-AS 21 61 980, there are no objections, when only the required strength considerations are taken into account, to reduce the thickness of the border blocks to about 50 millimeters and that of the transverse blocks to about 70 millimeters. However, other limits stand in the way of a further reduction of the thickness of the border blocks below the tested value of 70 millimeters in the available horizontal chamber coking ovens, which are attributable to the particularities of the manufacture of the refractory blocks and to the dimensioning of the heating wall, especially the center distances of the heating flues and the center distance of the coking chamber.

For safety reasons, the heating walls of large-volume coking ovens are being erected from even thicker border blocks. As a result of this, the possibility of the shortening of the duration of the coking operation by the reduction of the thickness of the border blocks can be advantageously used only under certain and very limited circumstances.

A further limit is established by the properties of the refractory materials which are available and suited for the construction of the heating walls bounding the coking chamber of the coking oven. This limit is given by nature in character and relates to the heat-transmitting properties of the refractory materials and the expansion properties of these refractory materials. In this respect, the available tolerances have been already fully explored and exhausted.

A further disadvantage of the conventional heating walls of this type is to be found in the fact that these walls usually have a constant thickness throughout so that even the heat-transmitting properties are the same over the entire heating wall and cannot be coordinated with the requirements of a different heat consumption on the part of the coking coal.

SUMMARY OF THE INVENTION

Accordingly, it is a general object of the present invention to avoid the disadvantages of the prior art.

More particularly, it is an object of the present invention to so construct the heating wall, particularly for use in a coking oven, as not to be possessed of the above-discussed disadvantages of the prior-art heating walls.

A further object of the present invention is to so design the heating wall as to further reduce the period of time needed for coking the charge of coal contained in the coking chamber of the coking oven.

A concomitant object of the present invention is to improve the transmission of heat through the heating wall to the charge of coal to be coked.

Still another object of the present invention is to provide a heating wall the transmission of heat through which can be correlated to the heating requirements of the charge contained in the coking chamber.

In pursuance of these objects and others which will become apparent hereinafter, one feature of the present invention resides, in a horizontal coking oven of the type having a heating wall which separates a coking chamber from heating flues, briefly stated, in the improvement wherein the heating wall bounds at least one enclosed compartment located between and separate from the coking chamber and the flues. In this connection, it is to be mentioned that the compartment in the heating wall is fully enclosed, that is, it does not communicate either with the coking chamber or with the heating flues or, for that matter, not even with the exterior of the coking chamber. In other words, the compartment is not being used for conducting any gases and thus it does not have any openings or orifices through which such gases could pass in or out of the compartment. Thus, only the gas which is entrapped within the compartment can circulate therein, particularly in convection currents and carry heat between the surfaces which bound the enclosed compartment. On the other hand, it is to be mentioned that the compartment need not necessarily be provided and enclosed within one of the refractory blocks of which the heating wall consists. Rather, the compartment could be configured as a channel or a passage in the respective refractory block which becomes fully enclosed only when the respective refractory block is assembled with other adjoining blocks into the heating wall. What is important for the present invention, though, is that this compartment is fully enclosed within the heating wall, that is, no flow of matter occurs between the compartment and the surroundings of the heating wall.

In this connection, it is to be mentioned that the improvement of the heat-transmitting properties of the heating wall by providing the compartment therein is quite surprising, especially inasmuch as this runs contrary to the experience encountered in connection with hollow blocks used for erecting walls or the like. More particularly, it is well known that, in the construction industry, hollow building blocks are being used when it is desired to provide heat insulation. Contrarily thereto, the opposite effect is obtained in accordance with the present invention when the heating wall is provided with the enclosed compartment, that is, the heat-transmissivity of the heating wall is increased. In other words, the heat transmission between the heating flue through the heating wall provided with the above-mentioned enclosed compartment is better than that obtained with a solid refractory block not having such a compartment, and that to a considerable degree. The substantially improved heat transmission effect from the heating flue through the heating wall having the enclosed compartment to the charge of the coking oven chamber is achieved for all materials which come into consideration for the manufacture of the refractory blocks of the heating wall, that is, for instance, chamotte, silica, mullite, sillimanite or the like.

When the present invention is resorted to, there is achieved the advantage, as compared to the known constructions of coking ovens, that the safety requirements can be better satisfied while giving the refractory blocks the same or only slightly larger thickness than before while the heat transmission through the refractory blocks between the flues and the coking oven is significantly improved. In order to give even the transverse blocks better heat transmitting properties without having to accept the disadvantages which arise from the necessary material thicknesses, even the transverse blocks, like the border blocks, can be formed with or can together form at least one, but preferably a plurality of enclosed compartments within the heating wall.

In order to achieve a possibly uniform flow of heat between the flames burning in the heating flues and the charge of the coking chamber over the entire height of the coking chamber and/or over the entire length of the coking chamber, without having to vary the outer dimensions of the refractory blocks, it is proposed, according to a further aspect of the present invention, to vary the dimensions or distribution of the enclosed compartments, either in the horizontal or in the vertical direction, gradually or stepwise or, whenever necessary, maintain the number and dimensions of the enclosed compartments constant at least over a certain area of the heating wall. In this manner, the heating wall can be easily erected inasmuch as the refractory blocks, which have the same outer dimensions, can be easily assembled with one another, and still the heat-transmitting properties of the heating wall can be varied from one portion of the heating wall to another. As already mentioned above, an increase in the number or dimensions of the enclosed compartments in a given portion of the heating wall will result in an improvement of the heat flow, while a decrease in one of the abovementioned parameters will have the opposite result.

While the present invention is particularly useful when employed in horizontal coking ovens, it is also proposed by the present invention to use for the same concept in other applications for refractory blocks of arbitrary shapes wherever it is desired to achieve an improved heat transmission in the temperature region above 1000° C.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1*a* is a horizontal section through a heating wall, taken between two layers of refractory blocks which are provided, in accordance with the invention, with fully enclosed compartments;

FIG. 1*b* is a view corresponding to FIG. 1*a* but illustrating a different type of refractory blocks;

FIG. 2*a* is a view similar to FIG. 1*a* but illustrating compartments which are partially open prior to, but completely enclosed subsequent to, the erection of the heating wall; and FIG. 2*b* is a view similar to FIG. 2*a* but illustrating the refractory blocks of FIG. 1*b*.

DESCRIPTION OF THE PREFERRED EMBODIMENTS

Referring now to the drawings in detail, and first to FIG. 1*a* thereof, it may be seen that the reference numeral 1 has been used to designate each of a plurality of individual heating flues provided in a heating wall of a horizontal coking oven. The heating wall includes a plurality of border blocks or bricks 2 of a refractory material, and a plurality of transverse blocks or bricks 3, also of a refractory material. The refractory blocks 2 and 3 together bound the individual flues 1 and separate the same from a coking chamber of the coking oven which is situated next to and bordered by the heating wall, and from one another.

In accordance with the present invention, the border blocks 2, as well as the transverse blocks 3, are provided with respective compartments 4 which, as illustrated in FIG. 1*a*, are completely enclosed within the respective refractory block 2 or 3. It may be seen that the compartments 4 are located in that section of the heating wall which is located between the individual flues 1 and the coking chamber. As illustrated, the heating wall is shared by two adjacent coking chambers of a coking oven battery, as customary in the coke-producing field, so that the enclosed compartments 4 are provided in both of the parallel sections of the heating wall which respectively bound the two coking chambers.

It will also be seen from FIG. 1*a* that the enclosed compartments 4 of the transverse blocks are provided only in those regions of the refractory transverse blocks 3 which adjoin the respective coking chamber. In this manner, the flow of heat through the affected regions of the transverse refractory blocks 3 is improved, while the heat-transmitting and particularly the stress-withstanding properties of the remainder of each of the refractory transverse blocks 3 remain uneffected. It may also be ascertained from FIG. 1*a* that at least the transverse blocks 3 in the superimposed layers of the heating wall are connected with one another by means of elongated tongues which are received in corresponding grooves of the other layer. It may also be seen that at least the transverse blocks 3 may have a stepped configuration which is complemented by a correspondingly stepped configuration of the superimposed transverse blocks 3. These expedients are quite conventional so that they have been illustrated only in a diagrammatic fashion.

Turning now to FIG. 1*b*, it may be seen that the refractory blocks 2 and 3 again are provided with the fully enclosed compartments 4 discussed above in connection with FIG. 1*a*. However, contrarily to the latter, the shapes of the refractory blocks 2 and 3 are somewhat different and, because of that, even the shapes of the enclosed compartments 4 in the refractory transverse blocks 3 are somewhat different. Here again, the refractory blocks 2 and 3 are connected to one another, within the same layer but also possibly between the layers, by tongue-and-groove connections.

Referring now to FIGS. 2*a* and 2*b*, it is to be mentioned that as far as the outer dimensions of the refractory blocks 2 and 3 and their functions go, they are the same as those in FIGS. 1*a* and 1*b*, respectively. However, in contradistinction to FIGS. 1*a* and 1*b*, the refractory blocks 2 and 3 of FIGS. 2*a* and 2*b* are provided with a greater number of compartments 5 having smaller dimensions. Another important distinction resides in the fact that the compartments 5 are not fully enclosed. Rather, these compartments 5 become enclosed only when the individual refractory blocks 2 and 3 are assembled in the heating wall. So, for instance, the compartments 5 which are shown as being open at the top, can be closed at the bottom so that, when the next layer is superimposed on the illustrated layer of the refractory blocks 2, 3 the closed bottoms of the compartments 5 of the superimposed layer of the refractory blocks 2, 3 will close the open tops of the compartments 5 of the illustrated layer of the refractory blocks 2, 3.

The enclosed compartments 5 of FIGS. 2*a* and 2*b*, however, need not necessarily be enclosed within a single one of the respective refractory blocks 2 or 3. Rather, the comparments 5 of the individual superimposed refractory blocks 2 or 3 may communicate with one another so long as it is assured that the respective compartment 5, in its entirety, will be fully enclosed within the heating wall, thus not permitting any flow of fluids into and out of the respective compartment, which would detrimentally influence the heat transmissivity of the heating wall.

It will also be appreciated that the compartments 5 need not necessarily be bounded over their lengths by a single one of the refractory blocks 2 or 3. Rather, the compartments 5 could be formed, in the erected wall, by the juxtaposition of channel-shaped recesses at the adjoining surfaces of the refractory blocks 2, 3. Here again, the crucial condition to be met is that, no matter how the compartments 5 are bounded, they be fully enclosed within the heating wall or the respective portion thereof.

The refractory blocks 2 and 3 of FIGS. 1*a* and 2*a*, on the one hand, and of FIGS. 1*b* and 2*b*, on the other hand, could be combined with one another over the length or the height of the heating wall so as to influence the heat-transmission properties of the various portions of the heating wall. On the other hand, the dimensions of the compartments or their number could be varied among the respective refractory blocks 2 and 3 which constitute the heating wall so that different heat-transmission properties can be obtained at various portions of the heating wall, in dependence on the amount of heat which is to be transmitted between the various regions of the heating flues 1 and the various regions of the charge of coking coal contained in the coking chamber. Thus, to give an example, one of the refractory blocks 2 of FIG. 2*b* could have only two rather than three of the compartments 5. Also, it is possible to make the compartments 5 of one of the blocks 2 or 3 smaller than illustrated, while keeping the other compartments 5 the same. As mentioned before, an increase in the number or the dimensions of the compartments in the respective refractory blocks 2 or 3 will result in an improved heat-transmissivity, and visa versa. In this manner, the heating wall can be so erected from the refractory blocks 2 and 3 which have the same outer dimensions that different portions of the heating wall will have different heat-transmission properties, as desired.

EXAMPLE

The heating wall of the present invention used in a horizontal coking oven is provided with vertical heating flues 1, the heating wall being erected from border blocks 2 of 100 millimeters thickness which are provided with the compartments 4 or 5 of 35 millimeters width. The width of the coking chamber is 440 millimeters, the heat transmission coefficient of the material of the refractory blocks 2 and 3 is 1.5 Kcal/mh° K. The temperature of the heating wall was 1263° C., the bulk density of the coking coal was 780 kg/m$^3$ and the water content of the coking coal was 10.6 wt. %. Under these conditions a coking oven having the heating wall in accordance with the present invention is compared to that having the same parameters but having border blocks of 100 millimeter thickness without the compartments, the overall heat-transmission capacity of the heating wall in accordance with the present invention exceeds that of the conventional heating wall by up to 50%. In this manner, the duration of the coking operation can be reduced by up to 20%.

It will be understood that each of the elements described above, or two or more together, may also find a useful application in other types of constructions, differing from the types described above.

While the invention has been illustrated and described as embodied in a heating wall for use in a horizontal coking oven, it is not intended to be limited to the details shown, since various modifications and structural changes may be made without departing in any way from the spirit of the present invention. So, for instance, the same concept could be used in other applications, such as in the other types of ovens, in regenerators or the like where it is important that an improved heat transmissivity be achieved in the temperature region above 1000° C.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a horizontal coking oven of the type having a coking chamber and heating flues, and a heating wall which separates the coking chamber from the heating flues, the improvement wherein said heating wall is provided with at least one sealed gas-containing compartment located between and separated from the coking chamber and the flues, whereby the rate of heat transmission from the flues through said wall and into the coking chamber is increased.

2. The coking oven of claim 1 which extends in a general horizontal direction and has a generally vertical heating wall and flues.

3. The coking oven of claim 1, having additional walls are also provided with similar compartments.

4. The coking oven of claim 1 wherein the size of the said compartment varies gradually or stepwise.

5. The coking oven of claim 1 wherein the number of compartments in each wall is equal throughout the walls of said oven.

6. The coking oven of claim 1 wherein the number of compartments varies throughout the walls of said oven.

7. The coking oven of claim 1, wherein the size of said compartment is equal to at least one of the height and length of the oven.

* * * * *